United States Patent [19]

Vogelsanger et al.

[11] 4,267,553

[45] May 12, 1981

[54] METHOD AND APPARATUS FOR SECURING ATTACHE CASES

[76] Inventors: Rolf Vogelsanger, Habuhlstrasse 11, 8704 Herrliberg; Anton Wicki, Auwiesenstrasse 17, 8050 Zurich, both of Switzerland

[21] Appl. No.: 1,286

[22] Filed: Jan. 5, 1979

Related U.S. Application Data

[63] Continuation of Ser. No. 927,548, Jul. 24, 1978, abandoned.

[30] Foreign Application Priority Data

Jul. 25, 1977 [CH] Switzerland ..... 9169/77

[51] Int. Cl.[3] ..... G08B 13/14

[52] U.S. Cl. ..... 340/571; 340/514; 340/666; 340/691

[58] Field of Search ..... 340/571, 665, 666, 521, 340/691, 514

[56] References Cited

U.S. PATENT DOCUMENTS

| | | | |
|---|---|---|---|
| Re. 27,618 | 4/1973 | Robeson | 340/571 |
| 3,656,144 | 4/1972 | Forte | 340/571 |
| 3,683,346 | 8/1972 | Horton | 340/691 |
| 3,740,741 | 6/1973 | Jones | 340/666 |
| 4,011,554 | 3/1977 | Butler | 340/514 |
| 4,057,791 | 11/1977 | Bimmerle et al. | 340/691 |
| 4,117,468 | 9/1978 | Vasquez | 340/571 |

*Primary Examiner*—Glen R. Swann, III

[57] ABSTRACT

An attache case is secured against unauthorized handling by providing an alarm and at least one sensor capable of sensing at least two conditions relative to the forces on said attache case. One of the conditions constitutes a predetermined safety state and the other of the conditions constitutes a force on the case deviating from said safety state by a predetermined value. The sensor is connected to the alarm by a trigger circuit so that the alarm is inactive during one condition and active during the other condition.

34 Claims, 9 Drawing Figures

METHOD AND APPARATUS FOR SECURING ATTACHE CASES

RELATED APPLICATION

The present application is a continuation of Ser. No. 927,548 filed July 24, 1978 abandoned the disclosure of which is incorporated herein as is more fully set forth.

BACKGROUND OF THE INVENTION

The present invention relates to an alarm system for containers such as attache cases.

Alarm systems for attache cases and the like have been known wherein the alarm is set to be activated when the attache case is snatched from the carrier's hand. Generally this is accomplished by attaching a manually operable switch to the handle of the attache case, which upon its release, triggers the alarm. The alarm system is so designed that it generates a monotone acoustic signal and may also generate intensive smoke and/or fog by means of built in petards. Basically, however, the known systems do not have the ability to monitor the attache case in a rest position wherein the case is set down and not transported and to monitor the condition during the transport so that when its position is changed, it gives an alarm.

The only safety state which is monitored in the prior art systems is respectively that of carrying the attache case by an authorized person or that of the case being in erect position and only deviation from the respective single safety state is evaluated for triggering the alarm. Other safety states for the attache case cannot be constituted selectably as the safety state to be monitored.

It is an object of the present invention to provide a system wherein it is possible to differentiate between at least two states or conditions for the attache case by which deviation from either of the conditions beyond a load safety factor would trigger the alarm. In accordance with the system of the present invention, it is possible to secure an attache case in safe condition practically in any position, and in active state against unauthorized contact, removal, or arrestation.

It is a further object of the present invention to provide an alarm system having an acoustic alarm signal unlike those presently known so as to be clearly distinguishable from surrounding environmental noises and having a level modulated in an undulating siren manner.

SUMMARY OF THE INVENTION

According to the present invention, the method for securing the transport container such as an attache case is provided comprising the steps of providing an alarm and at least one sensor capable of sensing at least two conditions relative to the forces on said attache case, at least two of said sensed conditions being selectable as a safety state, selecting one of said at least two selectable conditions as the safety state, the other or others of said sensed conditions constituting a force or forces on said case deviating from said selected safety state condition by a predetermined value and connecting said at least one sensor to said alarm so that said alarm is inactive during the selected safety state condition and activated on the occurrance of the other or others of said sensed conditions.

A simple embodiment of the present method is to establish that state as the safety state of the sensor into which the container is brought, either at rest or under movement, and establishing the first condition of said sensor. The present invention further provides an attache case having an alarm system wherein at least two positional states can be distinguished from each other, which system is characterized by providing at least one load sensor in addition to a central enabling switch in combination with an alarm means and by connecting at least one of the sensors together with the central enabling switch to the alarm means whereby the alarm may be triggered. To enable an operator, independent from any momentary load put on the attache case, to preset any load condition or situation as the safety state, it is proposed that means be provided for presetting the value of the safety load condition of the sensors. Thus, the deviation of the actual load from the safety state can be more readily regulated. The present invention also provides for a plurality of sensors which can be arranged for recording or sensing various load conditions over various parts of the attache case. For best results, individual selector means are provided predetermining which of of the sensors are to be placed in an operative or active position to determine the safety load state and the deviations therefrom for activating the alarm. In this manner, the user of the attache case can selectively choose the nature and position of the active sensors over the entire surface or interior of the attache case.

A rapid and safe activation of the alarm can be obtained when the sensors detect edges of altering load conditions for activating or triggering the alarm.

To prevent any unauthorized person from simply resetting the once triggered alarm systems, it is proposed that the system be arranged so that once it is triggered, the alarm may not be disabled. A delay period may be built in between the time the sensor senses the deviation from the safety state and the time the alarm is in fact actuated to enable a reset operation in this delay by an authorized person.

It is further proposed to provide means for resetting the system should there be an accidental triggering of the sensor. To this end, the alarm system is resettable by the use of a key or similar means which disengages the alarm and permits the resetting of the sensor system. Since under certain conditions, not every deviation of the actual load state from the safety state need result in triggering the alarm, means are included to provide a predetermined threshold value only over which the deviation will trigger the alarm. A threshold circuit, or pulse amplitude sensing circuit can be employed for reducing the trigger sensitivity of the alarm.

The sensors used in the present invention can be mechanical to electrical converters or pneumatic or hydraulic pressure sensors. So that the present invention can be actuated only by authorized personnel, it is proposed that the central control or enabling switch can be actuated by the special key or similar means only known to the authorized personnel. Operation of the attache case is simplified by combining its lock mechanism and the key actuated switch so that together they form the central enabling and reset mechanism.

The construction of the attache case and its design is further substantially simplified when the actuation of the central switch unit further establishes the connection of the sensors and the alarm means for eventual triggering of the alarm. This is accomplished by having the central switch connecting at least a portion of the sensors to the alarm on its actuation.

In specific situations, it may be necessary to obtain data on the amount by which the momentary actual load deviates from the safety load. Although in most situations it is only necessary to detect if or not the momentary actual load deviates from safety load. This is accomplished by having at least part of the sensors act to trigger the alarm by a two state signal.

The actual load value deviation from the safety load value can occur of course, in both algebraic signs i.e. in increasing or decreasing direction. Thus, a positive force deviation such as when putting the case on a table, may be exerted on the attache case or a negative force deviation such as when lifting the case. In this connection, the present invention provides for the use of a sensor which is responsive to positive force deviation applied upon the attache case and/or of a second sensor which is responsive to negative force deviation applied thereof. In order to be further selective as to which direction of deviation will produce a triggering signal for the alarm, provisions are made for equipping a pair of sensors with a positive and negative input signal clamping gate whereby the sensor outputs are switchable to trigger the alarm via an OR operand. Because the sensors are supposed to have a triggering effect on the alarm only after the latter's enablement by the central switch, the output of the OR operand is connected to this central enabling switch via an AND gate.

A preferred embodiment of the present invention has at least one sensor designed as an electrical switch, which according to either one of its two switching positions is designed for switch over between two electrical potentials. Then on actuating the enabling switch, the two position switch is connected to the alarm device so that each switch edge triggers the alarm. In this way it is important at which position the two position switch is switched when the enabling switch is operated. This becomes immediately evident because each change in the sensor output signal, be it in principle from 0 to 1 or from 1 to 0 triggers afterwards the alarm.

A switch embodiment suitable specifically for controlling the alarm by a signal edge is accomplished by utilizing a key or push button preferably on the container handle. Here too, the enabling effect is accomplished by having the switch and a enabling switch acting via the AND gate on the alarm. This connection is accomplished in a simple way by connecting the enabling switch into the electric supply line for the trigger circuit and connecting the switch to a trigger input whereby the alarm is hooked up to a corresponding electrical supply by a trigger circuit output signal and is triggered by a signal on the trigger input.

The alarm is designed to put out an acoustic signal. But, to give an authorized operator, who might carelessly trigger the alarm sufficient time to make a countermeasure, it is proposed that the alarm be developed to generate at least a two stage acoustic signal. The first stage being triggered initially and being of a lower intensity, to give warning to the operator. The second stage is effected thereafter, only after a preset period elapses, to issue a second alarm of higher intensity. Preferably a timer is provided for selecting the preset period of lower signal intensity.

To emphasize the acoustic signal over the environmental noise level, a proposal is made to provide a warble tone generator (sweep generator) for producing a frequency modulated acoustic signal.

To develop the alarm so that the alarm is extremely visible in the environment, it is proposed that the alarm include a fog or smoke generator which is designed to produce a colored smoke and/or emit a gas, which may produce temporary incapacity of the persons in the vicinity of the attache case.

A further variant is provided by utilizing the fog generation signal to put out a dye or colorant throughout the container contents in order to mark them. For example, banknotes can be marked for later recognition as being in the unauthorized possession of a thief. If the alarm is equipped with a fog signal generator and in addition is provided with an acoustic signal output which during a preset period sounds at a reduced intensity, then for a successive period at a rise in alarm intensity, it is possible that the alarm following the preset interval then fires the fog signal. Here too preferably timing means are provided for preselecting the further intervals.

To provide another embodiment, it is proposed that the system be provided to put out an optical indicator signal during a further preset interval. For safety reasons it is of advantage to sequentially switch the electrical leads for firing or igniting of a petard to the corresponding potentials, for example, first one to ground and then the second one to a firing potential. This is accomplished by providing switching means which connect one lead to one potential after a preset time interval and which connect a second lead to another potential after a further interval.

To give an operator a chance to constantly monitor the alarm for its troublefree operation and for the operation of the applicable trigger circuits, there are provided test circuitry. The test circuitry can be switched to provide an optical indication by bridging or short circuiting means, for the alarm means as a petard. The result is that the fog signal ignition without firing the signal generator as a petard can be checked without any problems.

Because unauthorized handling of the attache case may also include its opening, it is provided that a sensor triggering the alarm be also arranged on the container cover which latter sensor triggers the alarm upon lifting of the cover or opening of the attache case. With the container opened, it is desirable to have an immediate maximum alarm and therefore a maximum obstruction of unauthorized access is given. It is therefore proposed that the sensors responsive to the opening of the attache case immediately triggers the alarm and/or the fog ignition means.

For best results, once the fog signal ignitor has fired, it is preferably not possible to reset the system. This is accomplished by making the resettable means operative for the alarm in time periods prior to the termination of any interval necessary to effect the ignition of the fog generator.

Full details of the present invention are set forth in the following description and are shown in the accompanying drawings.

BRIEF DESCRIPTION OF DRAWINGS

In the accompanying drawings:

FIG. 1 illustrates a container such as an attache case comprising a bottom section 1 to which is hinged an upper cover 2. The component constituting the alarm mechanism 3 is mounted in the lower section which is covered by a shelf or divider 4 which is preferably removable. A handle 5 and a locking mechanism 6 which is preferably key operated is provided in conventional manner. Scattered over the surfaces of the case are a plurality of sensors 7, 8, 9 and 10 which in combination with the alarm system 3 are designed to provide an output signal should the load on any of the sensors deviate from a preset safety load.

The sensor 7, for example, is a push button sensor adapted to be held in closed position by the carrier of the case so that any disengagement of the push button will trigger the alarm, as will be the situation when the container is snatched from the carrier or when the container is lifted and the push botton depressed. Sensor 8 is associated with the lock 6 and is triggered should the lock be manipulated or opened. Sensors 9 are arranged about the surface of the case so that the alarm can be triggered if the case is deposited in a wrong position or if the sensor had been previously set for normal resting on a surface to be triggered if it is lifted from that surface. The sensor 10 is located within the case. Other sensors, and their placement will be obvious to those skilled in the art.

Figure 1:
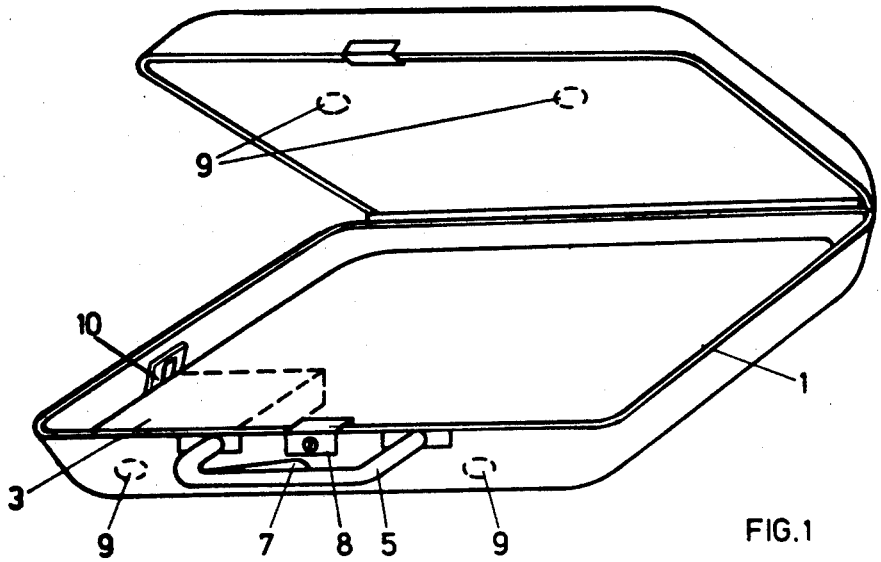
FIG. 1 is a perspective view of an attache case showing the position of the sensors and alarm means in accordance with the present invention.
Figure 2:
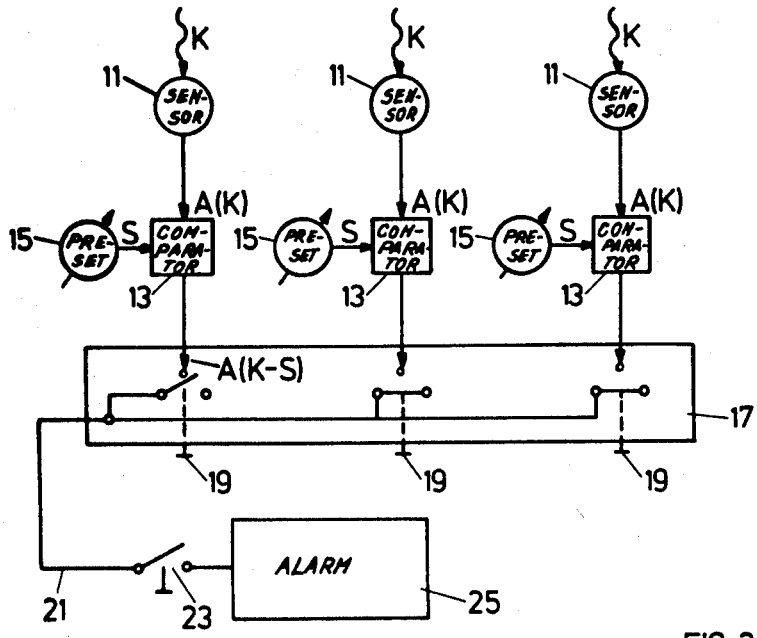
FIG. 2 is a schematical circuit diagram of an alarm system in accordance with the present invention.

The basic manner in which the alarm system can be triggered by the sensor is schematically illustrated in FIG. 2. The sensors, depicted in FIG. 1, are depicted in FIG. 2 by the reference numeral 11 and are adapted to record any change in loading by an external force effect K. This produces a signal A (K), which is fed to a comparator unit 13 to which a second base or preset signal S is fed from a preset generator 15. For processing electrical signals, the sensors are mechanical-electrical converters as, e.g., switches which are mechanically actuated to transmit electrical signals. The comparator units may be operational amplifiers or voltage comparators. The preset generators 15 may be realised by potentiometer means to select a preselected voltage value to be fed to one input of the associated comparator. The output of each of the comparator units 13 i.e. A (K-S) is fed to a selector unit 17 wherein each is fed to a single output line 21 and thence to an alarm 25, which may be audible or visual. For selecting among electrical signals at its inputs the selector unit may be constituted by an electronic multiplexer, e.g., by a set of analogue TET-switches or by a set of mechanically operated switches. Selection of the appropriate sensor for activation of the alarm is obtained by connecting by means of a switch 19 the output of respective comparators 13 to the output line 21. Enabling switch 23 is also inserted in line 21 before the alarm 25.

By presetting a corresponding safety load value S by each of the generator units 15 and by closing selected ones of the switches 19 as well as the enabling switch 23, the one or more than one of the sensors 11 will effect the triggering of the alarm 25 as soon as any one of them sense an actual load K greater than the safety load S.

The sensors 11 may be arranged anyplace on or in the attache case as desired. Each sensor may be different and may have a different or even variable load sensing factor and it is possible to provide the case with a plurality of sensors and to select only some to be activated by selection of the switches 19. It is thus possible to activate both sensors on supporting walls as well as on the side walls, which normally would not be employed to house sensor means. It may be possible to activate only those on the side walls if desired so that unauthorized contact in the lateral direction would be sensed and would result in triggering of the alarm. By presetting the safety load S various load conditions are possible. Thus, the sensors may be set so that the force A (K) is great enabling several cases to be laid one upon the other or heavy weights transported by the case, without prematurely triggering of the alarm.

Figure 3:
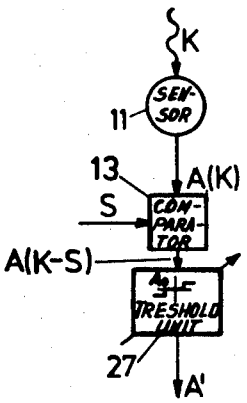
FIG. 3 shows a schematical circuit diagram of a sensor employable in the system of FIG. 2.

To provide specific tolerances within which an actual load A (K) may still deviate from the safety load without triggering the alarm, the basic circuit shown in FIG. 2 may be modified as shown in FIG. 3. In FIG. 3 a threshold circuit unit 27 is placed or staged after the comparator 13 and receive the output A (K-S). The threshold circuit unit 27 suppresses or gates any signal A (K-S) less than its set threshold $A_O$ and provides a signal A′ only if the output signal A (K-S) exceeds the amount of threshold value $A_O$. The threshold circuit unit 27 is capable of adjustment so that the threshold $A_O$ can be varied up or down (+ or −) to a preset sensitivity thereby enabling the entire system to be less or more responsive to load variation.

For processing electric signals the threshold circuit unit 27 may comprise a Schmitt-Trigger with variably settable hysteresis or may be combined with a comparator by choosing a voltage comparator with Schmitt-Trigger input-stage as is well known in the art.

Figure 4:
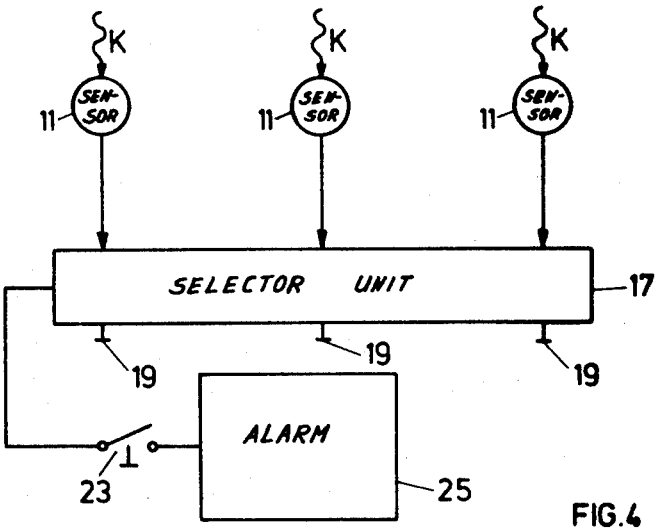
FIG. 4 is a schematical circuit diagram similar to that of FIG. 2 showing the use of sensors preset by the corresponding momentary value.

According to FIG. 2 the sensors 11 are coupled to the alarm 25 for triggering by the closing of selector switches 19 as well as a enabling switch 23. A simplification of this system is illustrated in FIG. 4 in which the adjustable signal generator 15 and its associated comparator unit 13 are omitted. The result of this is that the safety load state for the case may be preset by determining first the actual load state which is effective on closing switch 19 and 23. In other words, the case may be placed in a position corresponding to its safety state and thereafter the switches 19 and 23 are selectively closed. Thus, upon disturbing the case, the sensors 11 are activated and the alarm will be triggered.

Figure 5:
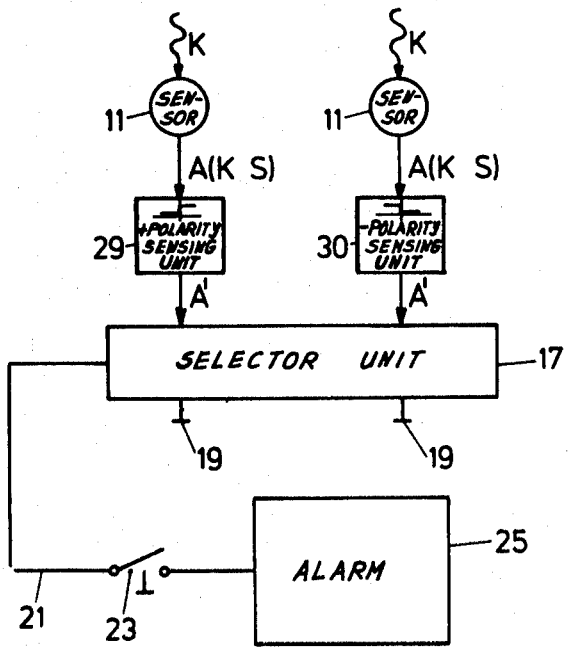
FIG. 5 is a schematical circuit diagram of an alarm system employing two sensors each of which records the load deviation in a given direction.

In each of the embodiments of FIGS. 2 to 4, the deviation of the actual load state from the safety load state is sensed regardless of the polarities or the direction of the force of deviation. In specific situations however, it may be advantageous to be able to selectably sense deviation in one or the other or in both directions from the safety state. Such a system is shown in FIG. 5 wherein the illustrated two sensors are provided respectively with an appropriate polarity selector unit 29 and 30 so that for example, unit 29 provides an output signal A′ only when a positive deviation of the actual load state is sensed and unit 30 analogously provides an output signal A′ when the actual load state drops below the safety state. If the sensors 11 provide electrical output signals one signal polarity may simply be clamped by a diode at the output of the sensor. By employing selector switches 19 in conjunction with each of the sensors 11 it is again possible to establish which one or both of the deviation polarities is to trigger the alarm. Thus, the safety state may be selected as the state where the attache case is being carried so that upon putting the case down, an increase in load on the sensor would trigger the alarm. On the other hand, a safety state may be established wherein the case is at rest and the lifting of the case will decrease the load so as to similarly trigger the alarm.

In principle, the selector switch 19 must be inaccessible to unauthorized persons so that their selection can be unknown to them. This is accomplished by placing these selectors, for example, on the interior of the case and preferably suitably encoded by electronic means or by keying means so as to resist tampering. The selector unit 17 and the selector switches 19 can be omitted if it is desired to utilize each one of the sensors to trigger the alarm directly.

Figure 6:
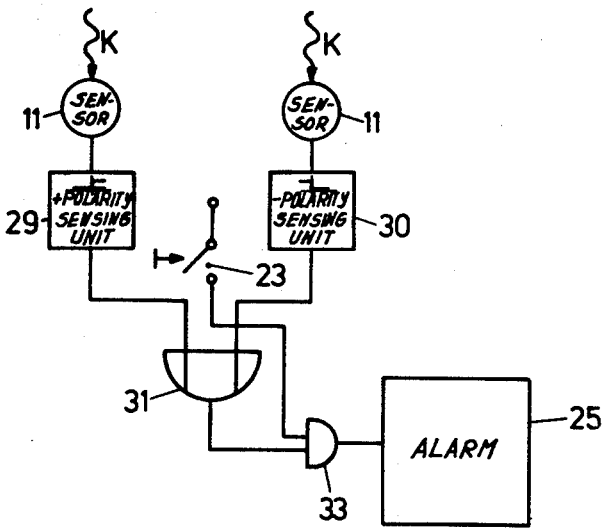
FIG. 6 is a schematical circuit diagram of an arrangement similar to that of FIG. 5 wherein the sensors act in an alternative sense.

FIG. 6 shows how sensors 11 may be linked in an electronic logic circuit with polarity sensitive units 29 and 30 (such as shown in FIG. 5) so that upon the closing of the enabling switch 23 a change in load enables the triggering of the alarm 25 directly. To this end, the outputs of the polarity selector units 29 and 30 are fed to an OR-unit 31 (transistor, diode or the like), the output of which is connected to an AND-unit 33, the other input of which is connected to the enabling switch 23. Thus, after closing switch 23, any change regardless of polarity will trigger the alarm. The enabling switch 23 assumes a further degree of importance in interpreting the load state by which the initial load condition of the safety state and any deviation from it results in triggering the alarm, since without it the alarm would not be triggered. Switch 23, thus conveniently can be the handle sensor, or push button 7 shown in FIG. 1, which while being held by the carrier is maintained in open state. Thus, in the circuit of FIG. 6, so long as the carrier is in possession of the handle, i.e. the case, no alarm will be given. However, should the carrier release the handle, then an alarm would be given as soon as the sensor 11 senses a change in state.

In principle, the sensor 11 schematically shown in FIGS. 2 to 6 can be mechanical electrical converters or transducers, for example, micro-switches, or inductive or capacitances strain and stress gauges, such as piezo electrical elements. On the other hand, the entire arrangement can be designed as a pneumatic or hydraulic system wherein the sensors are responsive to changes in hydraulic or pneumatic pressure flow, etc. The sensors of any of these types together with the associated equipment necessary to carry out the foregoing circuitry, such as the AND or OR gates, or the presettable units (such as potentiometers), are well-known and those in common usage may be employed here. Suitable power sources such as batteries, hydraulic or pneumatic feeding means, contacts, leads, switches, etc. are also common and can be employed.

Figure 7:
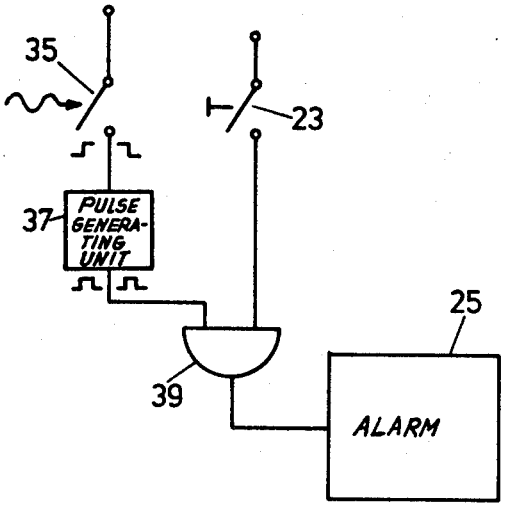
FIG. 7 is a schematical circuit diagram of an alarm system wherein the sensor is in the form of a switch.
Figure 8:
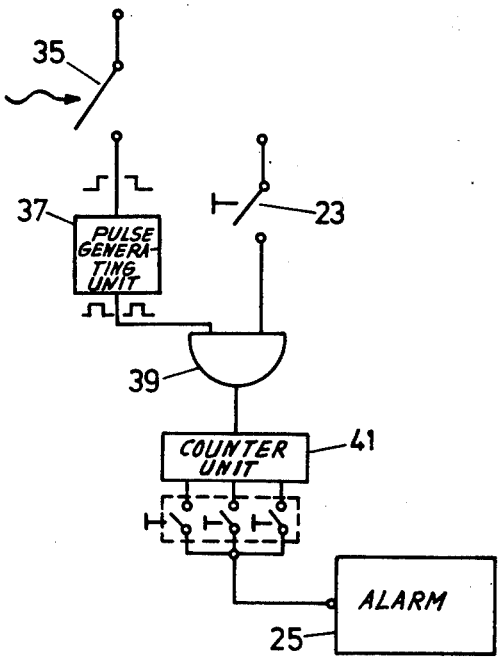
FIG. 8 is a schematical circuit diagram similar to that of FIG. 7 showing the use of counter means for providing the delay in triggering the alarm.

In the embodiment illustrated in FIG. 7, the sensor provided is a simple switch 35, preferably an electrical switch such as a micro-switch providing when being closed and when being opened a signal edge. The output edge of this micro-switch triggers a pulse generating triggering unit 37 which is connected together with the enabling switch 23 via an AND-unit 39 to the alarm 25. This arrangement can be supplemented as is seen in FIG. 8 by the placement of a counting circuit 41 between the AND gate 39 and the alarm 25. Preferably the counting circuit may be externally preset, as is shown by the broken lines so that a predetermined number of counts or pulses are necessary to provide a single output therefrom. As every output signal edge from switches or sensor 35 enables a pulse unit 37, every switch over of switch 35 is counted in counter 44. This arrangement can be used to the effect that prior to transport of the case, the counter 41 may be preset so that a predetermined number of switch overs of the switch 35 must be made before a pulse is sent to the alarm 25. The switch 35 for example, may be employed as the push button 7 shown in FIG. 1 so that a single release of the handle would not set the alarm. It is only after the predetermined number of transfers of the case are made that the alarm would be activated. This permits the case to be transferred from one courier to another if necessary for its transport. Of course, several sensors 35 may be set in parallel feeding to the counter.

Figure 9:
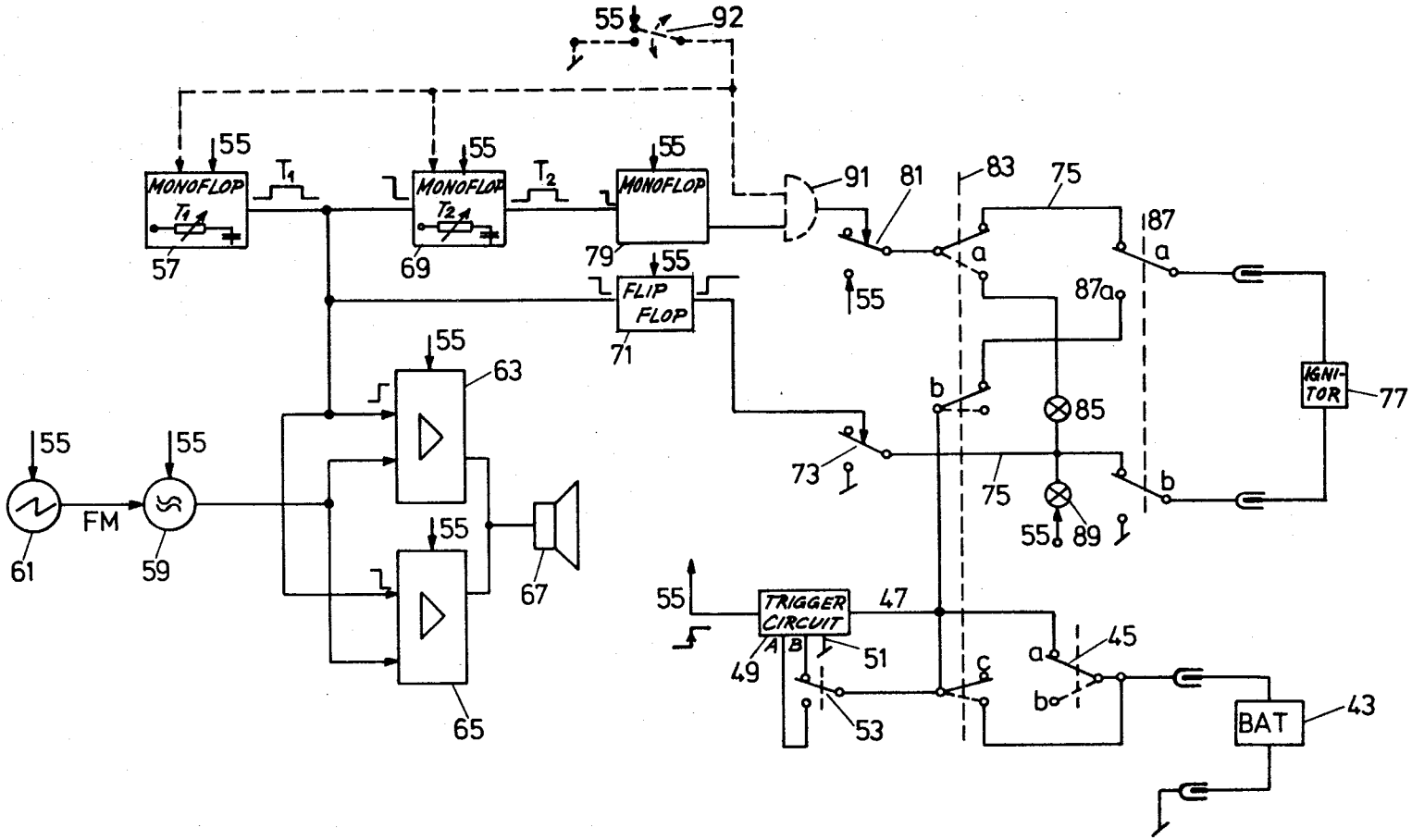
FIG. 9 is a block circuit diagram of another embodiment of the present invention.

FIG. 9 illustrates in detail an entire alarm system including the trigger device previously indicated in FIG. 7. It is understood, however, that the alarm system can be coupled also with the trigger devices according to any one of FIG. 2 through 6 and/or 8. While the system shown in FIG. 9 is an electrical circuit, the analogous pneumatic or hydraulic elements can also be employed as will be obvious.

As seen in FIG. 9, the circuit comprises a battery 43, one terminal of which is connected to ground, the other terminal of which is connected to an ON-OFF switch 45. The ON-OFF switch leads to one supply input pole 47 of a trigger circuit 49 such as previously described containing a pulse generator and AND gate. The second supply input pole 51 of the trigger circuit is grounded. The trigger circuit 49 is provided with two input terminals A and B to which a sensor switch 53 having a contact connected to the input supply pole 47 is connected so that on its switch over the potential of line 47 is switched from the input A to the input B and vice versa. As a result of the transmitted signal edge, a voltage step signal will appear at the output 55 of the trigger circuit 49. If the ON-OFF switch 45 is switched to the OFF position b, then the entire circuit is cut off from its electrical power supply so that only after enablement, that is switch over of the switch 45 to the ON position a and the subsequent switch over of the sensor switch 53, a supply voltage step will appear at the output 55. The voltage at high level at the output 55 is fed to a first monostable unit 57, which is triggered by the edge of the signal at 55 to produce an output pulse of a predetermined length $T_1$. The monostable unit 57 is adjustable to provide a pulse of predetermined duration, preferably for a time period of 10 seconds for instance by varying a resistor in a pulse width defining RC-stage.

The output signal on line 55 from the trigger circuit 49 is also fed to an audio oscillator 59 and a sweep generator 61 so that at the output of the audio oscillator 59 a frequency modulated signal will appear. This frequency modulated output signal is fed to two volume controls 63 and 65. The volume control 63 amplifies the frequency modulated output signal to a substantially greater degree than does the volume control 65, the latter being activated by the first edge of the pulse emitted by the monostable multivibrator 57. Thus the frequency modulated signal is fed to a loud speaker 67 with relatively low amplitude producing a level varying buzzing sound. The rear slope or edge of the pulse with a width of $T_1$ derived from the monostable unit 57 turns off the first volume control 63 and turns on the second volume control 65 so that the loud speaker 67 now produces a siren like level fluctuating signal.

Simultaneously, the second edge of the pulse $T_1$ emitted by the monostable unit 57 triggers a second monostable unit 69 which is supplied simultaneously by the output signal step of the trigger circuit 49 thus producing a pulse having a width of $T_2$ at its output. The width of this pulse $T_2$ is preferably preset by timing means for a period in excess of the period of the first pulse $T_1$ and preferably for 20 seconds, e.g., by a RC-stage with variable register.

Simultaneous with the triggering of the second monostable unit 69, a bistable unit 71 is triggered by the second edge of the $T_1$-pulse. The output signal step of the bistable unit 71 activates a relay having a contact comprising a first ignition switch 73 which is then moved into ground position, connected via a supply line 75 to an ignitor 77 for a fog or gas dispensing apparatus. Thus, at the end of time period $T_1$ set by the first monostable unit 57, one pole of the electrical ignitor 77 is grounded and the second monostable unit 69 is triggered. The second monostable unit 69 is connected to a third monostable unit 79 emitting a short pulse on the second edge of the $T_2$-pulse. Consequently, at the end of the time period $T_1+T_2$, that is following the second switching edge of the $T_2$-pulse generated by the second monostable unit 69, the third monostable unit switches a second ignition switch 81, by appropriate relay driven by said monostable's output pulse, so that the switch 81 is switched in contact with the feeding step output signal 55. This places a potential difference across the ignitor 77 so that it is capable of firing a fog or gas dispensal unit connected to it.

A test system is provided comprising a multicontact switch 83 shown in the test-off position by the solid lines in FIG. 9. In the test position, contact a interrupts the connection between the ignition switch 81 and the ignitor 77 and makes contact (dotted lines) with an optical indicator 85 such as a light emitting diode, the second pole of which becomes connected to the second ignitor switch 73 and from there to ground. Thus, instead of firing the ignitor, the test system emits a visual indication switching on the LED 85 upon the created step signal 55.

The closing of the enabling switch 45 in its on position (contact a) while maintaining the test switch 83 in its normal operative condition (solid lines) creates a connection of the applicable battery pole to the second contact arm b of the switch 83 and closes a circuit with a contact 87*a* of a second multi-contact switch 87, the purpose of which will be discussed hereinafter. If the switch is in test-on position (dotted lines) and switch 45 is disabled (dotted line) the contact arm of switch 83 short circuits switch 45 completing the circuit to the trigger circuit 49.

The second multi-contact switch 87 is normally in operative position (full lines), but switching over causes its first contact arm a to switch one pole of the ignitor 77 to contact 87*a* and thus on one battery pole. The second contact b of switch 87 is simultaneously switched to ground. Thus, the ignitor 77 is actuable, that is fired by activation of the switch 87 if the enabling switch 45 is in "a"-position and if the test switch 87 is in "test-off" that as in its shown position. Preferably, the switch 87 is mounted so as to be actuable directly upon opening of the attache case, so that the ignition is then directly fired without intermediate aubible signals. Actuation of the ignition by operation of switch 87 is barred in test-on operation by previous operation of switch 83, which opens contact 83*b* leaving contact 87*a* open.

A second light emitting diode 89 has one input connected to the output 55 of the trigger circuit 49 and the other input connected to the supply line 75 leading from the contact 73. The second LED 89 thus indicates the situation where the switch 73 connects one pole of the ignitor 77 to ground.

The test switch 83 enables the simulation of the entire alarm system through the indications given by both of the light emitting diodes 85 and 89. Preferably, the test is conducted when the container is (switch 87 in lower position) open and the central safety release switch 45 is placed in its off (b) position. The safety test switch 83 corresponds to the sensor switch 10 shown in FIG. 1 as being arranged inside of the container. As previously indicated, the sensor switch 53 may be the push button 7. The safety release switch 45 may be combined with the lock thus forming the key actuated switch 8 shown in FIG. 1.

Both the battery 43 and the fog signal ignitor 77 are connected to the circuit by removable contacts or plugs as shown in FIG. 9. The ignitor 77 may be replaced by other alarm indicating devices such as an audible alarm or bell while the battery may be replaced by a rechargeable battery.

As previously mentioned, it may be of advantage to be capable of resetting the once triggered alarm, that is prior to termination of the time period $T_1+T_2$. For this purpose a reset switch 92 resets on actuation monostable units 57 and 69, preventing by an AND-gate 91 the output pulse of unit 79 to be led to switch 81, which output pulse is also created when resetting the units 57 and 69. The reset switch is preferably actuatable by actuation of lock-switch 8 of FIG. 1, e.g., by a key, said lock-switch 8 thus taking over the enablement and the reset and locking functions.

In the embodiment of FIG. 9 the sensor switch 53 provides in analogy to switch 35 of FIG. 7 a rising as well as a falling edge, which both edges create a signal which leads to the ignition of the alarm means. The switch 53 of FIG. 9 is an electrical switch which is supplied with energy from the battery and which switches the battery potential from one to the other input of the trigger unit 49 or vice versa. Both actions as opening and closing of switch 35 in FIG. 7 trigger the trigger unit 49 to start the alarm control process.

It will be seen from the foregoing that contrary to the known attache cases or similar containers provided with safety alarm systems, the present invention provides unique advantages. The objects and advantages set forth in the introduction hereto have been fully met, as will be seen from the foregoing description. Various embodiments, changes or other modifications have been suggested in the description. Similarly, embodiments, changes and modifications will be obvious to those skilled in the art from the reading of the present disclosure. Accordingly, the present disclosure is to be taken as illustrative only and not as limiting of the present invention.

The following is a list of conventional electronic components which can be used to realise the intentive apparatus:

| Reference No. | Function | |
|---|---|---|
| 15 | preset generator | potentiometer: phillips 100h52 No 23 22 380 66 511 |
| 13 | comparator unit | operational amplifier or voltage comparator: Bourns cmp 01 Intersil 111 |
| 17 | selection unit | Multiplexer: in TTL realization or with analogue-Fet switches as Intersil dg 111/dg 112 |
| 29/30 | polarity sensitive unit | appropriate poling of diodes or z-diodes as: phillips bz x 79 |
| 31 | OR-unit | TTL or cmos as from Motorola mc 14570 |
| 33 | AND-unit | TTL or cmos as from Motorola mc 14571 |
| 37 | pulse generating unit on ↑ and ↓ | combination of two edge-triggered Monoflops, one for ↑, one for ↓: Motorola mc 14528 (cmos) |
| 41 | counter | binary or counter shift register Motorola mc 14015 (cmos) |
| 49 | trigger unit | two edge triggered, a combination of two Flip-Flops for ↑ and ↓ trigger: mc 14027 from Motorola cmos |
| 57 | monostable unit | monostable multivibrator mc 14528 from Motorola, cmos |
| 59 | generator | Oscillator for audible frequency with frequency control |
| 61 | sweep-generator | saw tooth generator |
| 69 | monostable unit | monostable multivibrator mc 14528 from Motorola cmos |
| 71 | bistable unit | bistable multivibrator mc 14027, Motorola cmos |
| 79 | monostable unit | monostable multivibrator mc 14528 from Motorola cmos. |

What is claimed is:

1. A method for securing a transport container such as an attache case against unauthorized handling comprising the steps of providing an alarm and at least one sensor capable of sensing at least two conditions relative to the forces on said attache case, each of said at least two conditions being selectable as a safety state, placing said attache case under a selected force, and selecting one of said at least two conditions to correspond to said selected force as the safety state, the other or others of said sensed conditions corresponding to a force or forces on said case deviating from said selected safety state condition by a predetermined value and connecting said at least one sensor to said alarm so that said alarm is inactive during the selected safety state condition and activated on the occurence of the other or others of said sensed conditions.

2. Apparatus for securing a transport container such as an attache case against unauthorized handling comprising a source of energy, an alarm and at least one sensor capable of sensing at least two conditions corresponding to forces acting on said attache case, means for selecting any one of the sensed conditions from among the at least two sensed conditions as a safety state and means connecting said sensor to said alarm so that said alarm is inactive during the safety state condition and is activated on occurrence of the other or others of the sensed conditions.

3. The apparatus according to claim 2 including an enabling switch means for enabling said alarm to be activated.

4. The apparatus according to claim 3 wherein said switch means is key operable.

5. The apparatus according to claim 4 wherein said case has a lock and said key operable switch means is a part of said lock.

6. The apparatus according to claim 3 including a trigger circuit, said enabling switch means comprising one input to said trigger and said at least one sensor providing a second input, the output of said trigger circuit being connected to said alarm.

7. The apparatus according to claim 2 including a plurality of sensors each having means for selectively connecting said sensors to said alarm.

8. The apparatus according to claim 2, said alarm comprising input means responsive to the transient of the changeover from the one to the other or others of said sensed conditions.

9. The apparatus of claim 2, the alarm comprising self-holding means for maintaining said alarm active once said alarm has been initially activated by the occurrence of said other or others of said conditions.

10. The apparatus of claim 9 comprising resetting means, said self holding means comprising timing means, said timing means enabling reset of said alarm by said resetting means for a predetermined time period after said other or others of said conditions had occured.

11. The apparatus of claim 2 including trigger means responsive to said at least one sensor for producing a step signal for activating said alarm.

12. The apparatus of claim 11 including means responsive to said step signal for delaying, for a predetermined interval, activation of said alarm.

13. The apparatus of claim 12 comprising resetting means for preventing activation of said alarm, said resetting means being operative only within said time interval.

14. The apparatus of claim 13 said resetting means being key operable.

15. The apparatus of claim 2 comprising treshold means interconnected between said sensors and said alarm to provide an output signal if the output signal of a respective sensor crosses a treshold value.

16. The apparatus according to claim 2 wherein said sensors are mechanical/electrical transducers.

17. The apparatus according to claim 2 wherein said at least one sensor produces a two state signal.

18. The apparatus according to claim 2 wherein said sensors are arranged in normal state to be responsive to an increasing force.

19. The apparatus according to claim 2 wherein said sensors are arranged in normal state to be responsive to a decreasing force.

20. The apparatus according to claim 2 wherein a pair of sensors is provided, one of it being arranged in a normal state to be responsive to a decreasing force, the other being arranged in a normal state to be responsive to an increasing force and including an OR gate interposed between said pair and said alarm.

21. The apparatus according to claim 2 including a switch connected to said source and a pair of sensors one of said sensors being arranged in a normal state to be responsive to a decreasing force, the other being arranged in a normal state to be responsive to an increasing force, an OR-gate and an AND-gate, said pair being connected to said OR-gate, the output of said OR-gate and said switch being connected to said AND-gate, the output of said AND-gate being connected to said alarm.

22. The apparatus according to claim 2 wherein said at least one sensor comprises an electrical switch having two switch positions whereby switch-over from either position into the respective other one producing an activating signal for said alarm.

23. The apparatus according to claim 22 wherein said two position switch is mounted on the handle of said case.

24. The apparatus according to claim 23 including an enabling switch for enabling said alarm to be activated, wherein said two position switch and said enabling switch are connected to an AND-gate, the output of which being connected to said alarm.

25. The apparatus according to claim 2 wherein said alarm is acoustic.

26. The apparatus according to claim 25 wherein said alarm comprises a two stage acoustic signal generator, one stage being responsive to a first signal and being of low intensity.

27. The apparatus according to claim 26 including means for timing said first signal.

28. The apparatus according to claim 25 including means for providing a frequency modulated warble acoustic alarm.

29. The apparatus according to claim 2 wherein said alarm comprises an explosive charge.

30. The apparatus according to claim 2, wherein said alarm comprises a gas petard.

31. The apparatus according to claim 30 wherein said petard is arranged to apply a colorant to the contents of said case.

32. The apparatus according to claim 2 wherein said alarm is optical.

33. The apparatus according to claim 2 including an optical monitor means and test means for disconnecting said alarm and connecting said monitor means instead of it.

34. The apparatus according to claim 2 including a trigger circuit, on which said at least one sensor acts, and further a time delay circuit, said alarm comprising an electrical ignitor with two electrical input connections, each being connected to a switch means, one of said switch means being connected to one electrical potential by said trigger circuit and the other switch means to the other potential by said time delay circuit, to perform sequential connection of the ignitor to an igniting potential difference.

* * * * *